US008727829B2

(12) United States Patent
Halliburton

(10) Patent No.: US 8,727,829 B2
(45) Date of Patent: May 20, 2014

(54) INFLATABLE, NON-LATEX BALLOON WITH SELF SEALING VALVE

(75) Inventor: James Halliburton, Crewe (GB)

(73) Assignee: Seatriever International Holdings Limited, Cheshire (GB)

( * ) Notice: Subject to any disclaimer, the term of this patent is extended or adjusted under 35 U.S.C. 154(b) by 161 days.

(21) Appl. No.: 13/391,275

(22) PCT Filed: Aug. 4, 2010

(86) PCT No.: PCT/GB2010/051289

§ 371 (c)(1),
(2), (4) Date: Feb. 17, 2012

(87) PCT Pub. No.: WO2011/021022

PCT Pub. Date: Feb. 24, 2011

(65) Prior Publication Data

US 2012/0148765 A1 Jun. 14, 2012

(30) Foreign Application Priority Data

Aug. 17, 2009 (GB) ..... 0914336.3

(51) Int. Cl.
*A63H 27/10* (2006.01)
*G09F 15/00* (2006.01)

(52) U.S. Cl.
USPC ..... 446/220; 446/224

(58) Field of Classification Search
CPC ..... A63H 27/10; G09F 15/00; B64B 1/40; F21V 33/00; F21V 21/30; F21V 14/02; F21V 19/02; F21V 21/14
USPC ..... 446/220–226; 362/253, 269
See application file for complete search history.

(56) References Cited

U.S. PATENT DOCUMENTS

| | | | | |
|---|---|---|---|---|
| 4,917,646 | A | 4/1990 | Kieves | |
| 5,188,558 | A | 2/1993 | Barton et al. | |
| 5,795,211 | A | 8/1998 | Carignan et al. | |
| 5,860,441 | A | 1/1999 | Garcia | |
| 6,602,105 | B1 * | 8/2003 | Sussell | 446/220 |
| 7,121,915 | B2 * | 10/2006 | Banks | 446/220 |

FOREIGN PATENT DOCUMENTS

| | | |
|---|---|---|
| EP | 1 600 690 | 11/2005 |
| WO | WO 2008/110832 | 9/2008 |

* cited by examiner

*Primary Examiner* — Kien Nguyen
(74) *Attorney, Agent, or Firm* — Ladas & Parry LLP

(57) ABSTRACT

An electronic unit incorporating an LED or a sound source, a battery power source, and a displaceable actuator to connect the LED or sound source to the power source, is mounted inside a non-latex balloon by firstly being bonded by means of a cover sheet to the exterior of one of the flexible strips of a self-sealing valve located in and through the neck of the balloon. This may take place by heat sealing and simultaneously with the bonding together by heat seal of the respective elongate strips of the valve. Thereafter, the combined unit and self-sealing valve are bonded, again preferably by heat sealing, between respective balloon sheets in the vicinity of the stem of the balloon. Winged portions on the inflation valve strips and the cover and corresponding bulges where the balloon body emerges to the balloon stem may be provided.

8 Claims, 3 Drawing Sheets

INFLATABLE, NON-LATEX BALLOON WITH SELF SEALING VALVE

This application is a 371 of PCT/GB2010/051289, filed on Aug. 4, 2010, which claims priority to Great Britain Patent Application No. 0914336.3, filed Aug. 17, 2009, both of which are incorporated herein by reference.

This invention relates to a self sealing non-latex balloon and a method for manufacturing such balloons to incorporate an electronics device, such as a device comprising a light emitting diode and power supply for same.

BACKGROUND

Non-latex balloons of the type comprising two flexible sheets of plastics material which are sealed together around their periphery in a variety of shapes and have a neck (also referred to as a stem) defining an opening for inflation of the balloon, typically by helium, are extremely popular. One or both of the sheets may be decorated or metallised. U.S. Pat. No. 4,917,646 discloses a self sealing valve in the form of a simple passageway provided between two elongate strips of plastics material which are sealed within the neck of the balloon during manufacture and extend into the space within the balloon. A bonding barrier, which may be provided by a coating on one of the strips, ensures that the passageway is kept open at the inlet during the heat sealing operation. The passageway may be narrowed by convergence between the lines of seal at the respective sides of the passageway, either at one or both sides, for example by a stepped or sloping section of one or both lines of seal, so that the size of the outlet from the valve into the space within the balloon is less than that of the inlet to the valve in the neck of the balloon. Such valves allow inflation of the balloon, but tend to closure so as to prevent escape of gas from the balloon, or at least allow escape of gas at such a reduced rate that the balloon will remain inflated for a sufficient length of time as required by the user, for example at least 24 hours. This is sufficient bearing in mind that such balloons are used mostly for celebratory and party purposes. Most commercially available balloons of this type incorporate this simple self sealing valve arrangement. p Various proposals have been made, for example in U.S. Pat. Nos. 5,795,211, in 5,947,581, in US 2002/0164919, in US 2004/0127138 and in WO 2005/103557 for mounting light emitting devices, specifically light emitting diodes (LEDs) within such balloons, in order to enhance the attractiveness of same. In U.S. Pat. No. 5,795,211, one or more LEDs are attached by adhesive tape to an inner surface of one of the sheets forming the balloon and connected to a battery power source located outside the balloon by way of a pair of flat conductor leads which are embedded in a strip of polyethylene and extend through the neck of the balloon. The polyethylene strip is heat sealed in the neck of the balloon alongside an elongate self-sealing inflation valve of the type described above. In US 2004/0127138 an assembly including an LED, a power supply cell, an electric circuit connecting the cell and the LED and a switch in the circuit, is suspended centrally within the space within the balloon by being mounted upon a strip of plastics material, one end of which is bonded between the respective sheets forming the balloon at one point around their periphery. In the other prior proposals just mentioned, the LED is part of a device which is adhered at a location within the space of the balloon to one of the respective sheets forming the balloon. Such mounting is likely to complicate the production of such balloons and they may not be economically viable.

An object of the present invention is to provide a method of incorporating an LED device or other electronic device into this type of non-latex balloon which does not require significant deviation from the methodology of conventional mass production of such balloons, and requires minimal or no additional assembly steps and is therefore cost-effective.

BRIEF SUMMARY OF THE DISCLOSURE

In accordance with a first aspect of the present invention there is provided a self-sealing, non-latex balloon having a body and a stem comprising, in combination: a first balloon sheet having an interior surface and a periphery; a second balloon sheet bonded to the periphery of the interior surface of the first balloon sheet so as to define the body and the stem; a self sealing valve comprising first and second flexible plastics strips bonded to each other to define an elongate passageway, said valve having a first floating portion within the body and a second portion which is bonded within the stem and defines an inlet; and an LED or a sound source mounted in the balloon, between the first and second balloon sheets; which is characterised in that the LED or sound source is part of an electronic unit mounted inside the balloon in or adjacent the stem of the balloon, said unit also including a battery source for the LED or sound source and a displaceable actuator to connect the LED or sound source to the power source, and in that said unit is secured to the valve by an attachment cover which is bonded to at least one of the strips of the valve and is also bonded within the stem of the balloon.

In accordance with a second aspect of the invention there is provided a corresponding method of production of a self-sealing, non-latex balloon having a body and a stem defined by a first balloon sheet bonded to a periphery of a second balloon sheet, said method comprising the steps of: forming a self sealing valve by bonding first and second flexible plastic strips to each other to define an elongate passageway having an inlet and outlet; providing an electronic unit comprising an LED or sound source, a battery power source for the LED or sound source and a displaceable actuator to connect the LED or sound source to the power source;positioning the electronic unit to overlie the second flexible plastic strip with the displaceable actuator extending towards the inlet of the valve; placing an attachment cover to overlie the electronic unit and bonding the attachment cover to the second flexible plastic strip so as to secure the unit thereto; positioning the bonded valve and electronic unit between in register first and second balloon sheets in the vicinity of the stem so that the electronic unit is located just beyond the stem between body portions of the balloon sheets and the displaceable actuator extends into the stem; and bonding the first and second balloon sheets together and to said valve and said attachment cover so that the valve has a first floating portion within the body of the balloon and a second portion bonded to the balloon stem.

In preferred embodiments of the balloon and its production method in accordance with the present invention the first and second flexible plastics strips of the valve and the attachment cover are configured to have winged portions which are aligned and bonded to each other. In this way a particularly reliable bonding between the attachment cover and one of the flexible plastic strips can be achieved.

Furthermore, the first and second balloon sheets are advantageously configured with enlargements adjacent the stem of the balloon to accommodate said winged portions of the valve and the attachment cover. Not only do these enlargements strengthen the balloon body in the vicinity of the incorporation of the electronic unit, they also most advantageously provide means of locating the combined valve and electronic unit during and after production of the balloon.

BRIEF DESCRIPTION OF THE DRAWINGS

The invention will be described further, by way of example, with reference to the accompanying drawings, in which.

DETAILED DESCRIPTION

Figure 1:
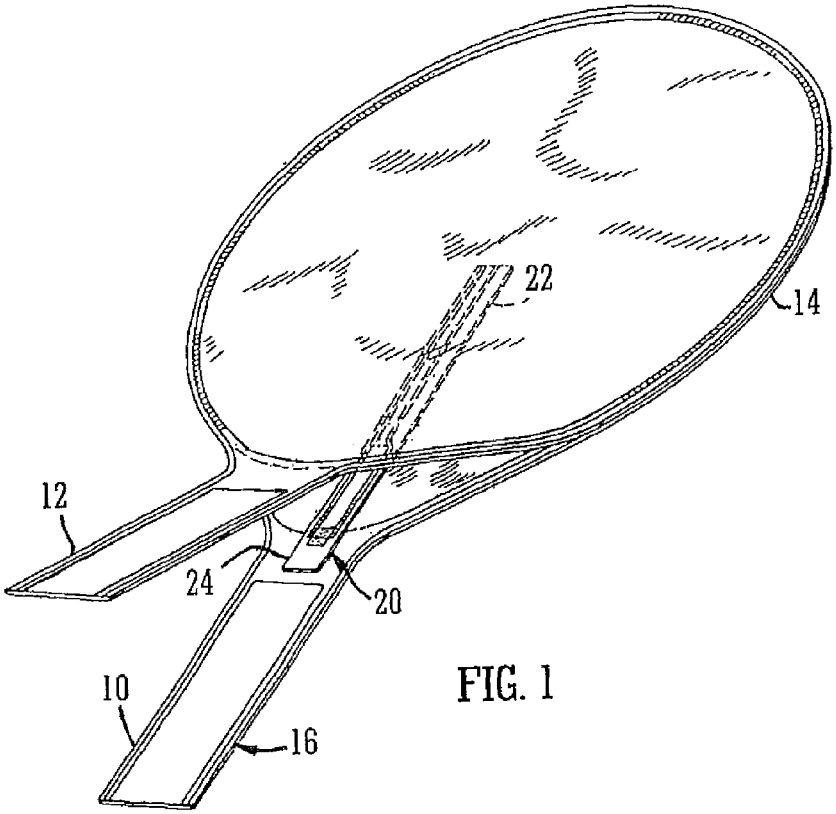
FIG. 1 is a perspective view of a prior art non-latex balloon with a self-sealing valve, one balloon sheet being shown peeled away from the other solely for illustrative purposes.

A known self-sealing, non-latex balloon, as shown in FIG. 1 comprises a first balloon sheet 10 and a second balloon sheet 12 which are bonded together, typically by heat sealing prior to or at substantially the same time as cutting to shape, around their periphery to define a body 14 and a stem 16. The balloon sheets 10, 12 are made of suitable heat-sealable material, such as polyethylene or a laminate of polyethylene and nylon, and one layer may be coated, at least partially, with a metallic compound to provide decorative effect. During the production process, a self-sealing valve 20 is inserted between the first and second balloon sheets 10, 12 so as to have a floating portion 22 within the body 14 and a second portion 24 bonded within the stem 16. Such a valve 20 is shown separately in FIG. 2. It simply comprises two strips of flexible plastics material, such as low-density polyethylene, which are sealed together, again typically heat sealed, but possibly by means of adhesive, along respective seal lines 26, 28 in order to define an elongate passageway 21 having an inlet 23 at one end and an outlet 25 at the other end. Typically, the outlet 25, which is located at the end of the floating portion 22 within the body 14 of the balloon, is made narrower than the inlet 23 by provision of an intermediate, sloping convergent region (or kink) 27 in one of the seal lines 26.

When the first and second balloon sheets 10, 12, are bonded together the heat sealing stamp also bonds the respective strips of the valve there between where the stem 16 merges into the body 14 of the balloon. A barrier coating 29 on one of these strips prevents heat sealing at the inlet 23. The balloon is inflated by insertion of a nozzle into the stem 16 and into the inlet 23 so that a gas such as air, or preferably helium, is supplied into the body of the balloon via the passageway 21. Once the balloon is fully inflated and the nozzle removed, the passageway 21 closes automatically due to the length of the valve 20 and the material of which it is made and there is little tendency for gas to flow out of the balloon body 14. Therefore, although the stem 16 of the balloon may be tethered, there is no requirement for tight tying off. The balloon will generally remain inflated to a reasonable degree for 24 to 48 hours at least.

Figure 3:
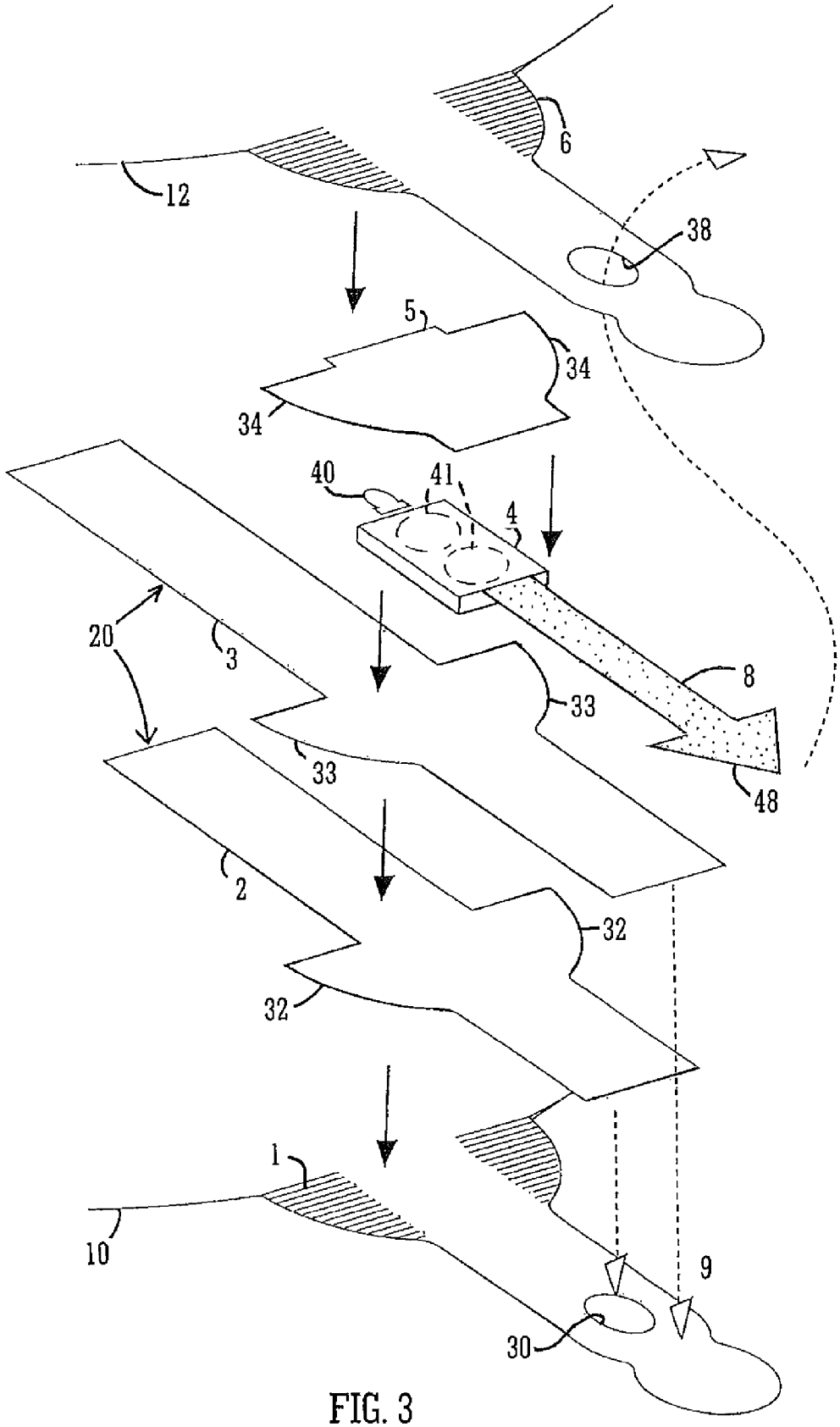
FIG. 3 is a fragmentary exploded view showing a portion of a practical embodiment of a balloon in accordance with the invention in the region of the balloon stem.
Figure 4:
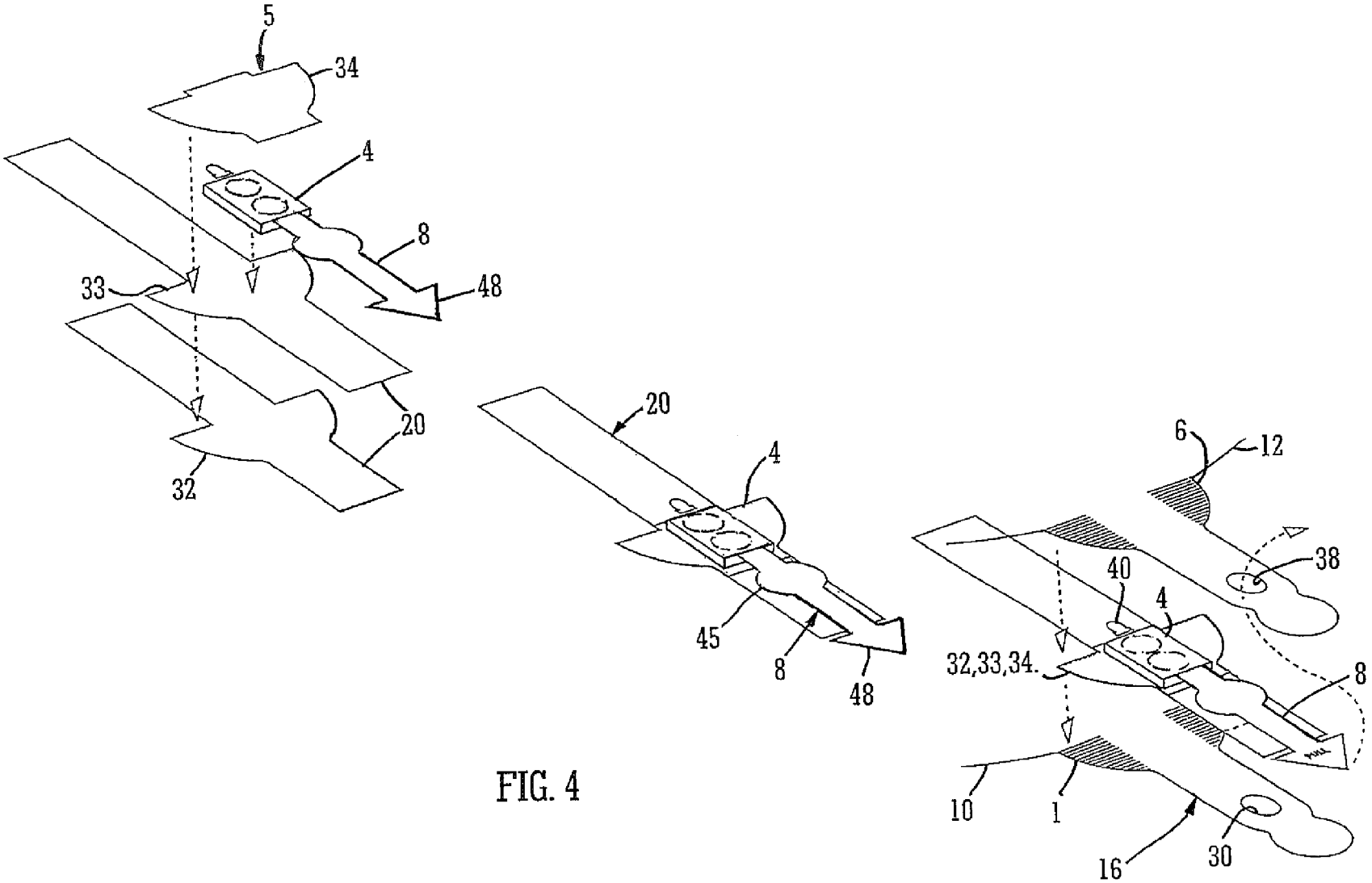
FIG. 4 is a series of smaller scale views, similar to FIG. 3, but showing the sequence of stages in the production of this embodiment of the balloon of the invention.

Referring now to FIGS. 3 and 4, in accordance with a preferred practical embodiment of the invention, a small electronic unit 4 incorporating a light emitting diode (LED) 40 is mounted into a balloon of the type just described at a location where the stem 16 merges into the body 14, thus at the same location as where the valve 20 is sealed into position. The electronic unit 4 comprises a housing to which the LED 40 is mounted, said housing enclosing batteries 41, disposed side-by-side, to which the LED 40 is connectable by conventional electric circuit means. However, a removable tab 8, comprising an elongate strip of plastics material or card or any other suitable non-conducting material is inserted into the unit 4 to prevent connection between the batteries 41 and the LED 40, so the LED 40 will only be illuminated by completion of the electric circuit when this tab 8 is pulled out. As shown in FIG. 3, the tab 8 has an enlarged outer end region in the form of an arrowhead 48. As shown in FIG. 4, the tab 8 has an additional enlarged region 45, in this case of generally rounded form, at a spacing from the arrowhead 48.

Figure 2:
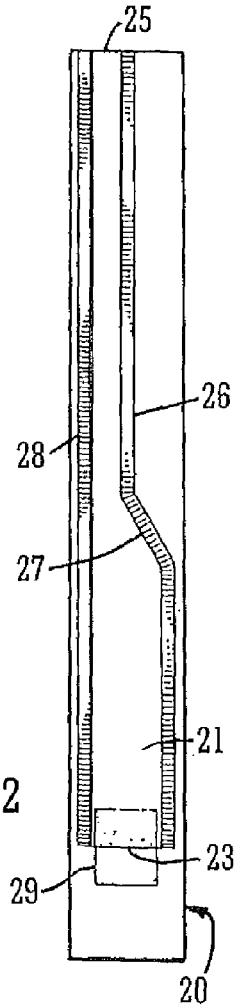
FIG. 2 is an enlarged plan view of the self-sealing valve of FIG. 1.
Figure 5:
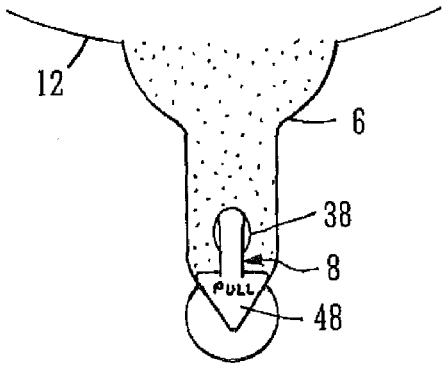
FIG. 5 is a fragmentary plan view from above of the same portion of the balloon as in FIG. 3 in the final fabricated form.

In FIGS. 3, 4 and 5 parts which correspond to the parts already described in relation to FIGS. 1 and 2 have been denoted by the same reference numerals and they are not now described again in any detail.

As shown in FIG. 3, the lower and upper strips 2, 3 of the valve 20 are provided with lateral wings 32, 33 which are in register with each other. An attachment cover 5 of same or similar material to that of the valve strips 2, 3 is also provided and has comparable wings 34, which are also overlaid in register with the wings 32, 33. The electronic housing unit 4 is positioned between the attachment cover 5 and the upper strip 3 so that by a single heat sealing operation, as shown at the left-hand end of FIG. 4, the edge seals of the valve 20 can be formed and the respective wings 32, 33, 34 bonded together so that the electronic LED unit 4 is secured by means of the cover 5 to the exterior of the upper strip 3 of the valve 20, as shown in the central stage depicted in FIG. 4.

Then, in a further manufacturing step, the integrated (bonded) valve and electronic unit 20, 4 is introduced between the first and second balloon sheets 10, 12. In this preferred embodiment, these sheets 10, 12 are formed with respective bulges 1, 6 where the stem 16 merges to the body 14 of the balloon. These bulges 1, 6 are of substantially the same shape and size as the wings 32, 33, 34 of the integrated valve/LED unit and are brought in register with these wings, as shown at the right-hand end of FIG. 4. In a further heat sealing step the balloon sheets 10, 12 are sealed around their periphery and an additional heat stamp portion bonds the bulges 1, 6 to the wings 32, 34.

Figure 6:
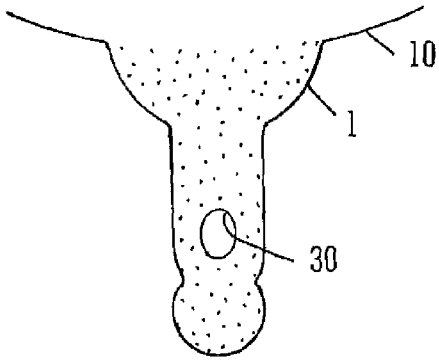
FIG. 6 is a view comparable to FIG. 5 but showing the underside of the same portion of the balloon.

As shown in FIGS. 3 and 4, and also in FIG. 6, an aperture 30 is provided in the stem portion 16 of the first balloon sheet 10 to allow access of an inflation nozzle to the valve 20, as is conventional. As shown in FIGS. 3, 4 and 5, an additional aperture 38 is provided in the stem portion 16 of the second balloon sheet 12 and in a final production step the arrowhead 48 of the tab 8 is pulled through this aperture 38 so that it is more readily acceptable for pulling by a user in order to extract the tab 8 and illuminate the LED 40 and the entire balloon. The second enlargement 45, which is optional, reduces any risk of inadvertent withdrawal of the tab through the aperture 38.

It will be appreciated that in use of the balloon the step of illumination of the balloon is completely independent of the step of inflation of the balloon. Accordingly, balloons can be inflated and positioned in advance of an event and illuminated only at the time required, thus prolonging the possible period of illumination, which is limited by the power of the batteries 41.

In a modified version, the attachment cover 5 may extend to cover the LED 40 in order to achieve more secure bonding of the unit 4 to the valve 20. The attachment cover 5 would, of course, in that case be transparent or substantially transparent.

In another modified version, in place of the tab 8, a displaceable switch may be provided which would not be removable but would allow the LED to be switched off and on.

In yet other embodiments of the balloon of the invention an electronic unit incorporating a sound source instead of or in addition to an LED may be provided so that a sound or tune may be emitted upon removal of the tab or displacement of a switch to energise the sound source.

Throughout the description and claims of this specification, the words "comprise" and "contain" and variations of them mean "including but not limited to", and they are not intended to (and do not) exclude other components or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features described in conjunction with a particular embodiment or example of the invention are to be understood to be applicable to any other embodiment or example described herein unless incompatible therewith. The invention is not restricted to the details of the foregoing embodiment. The invention extends to any novel one, or any novel combination, of the features disclosed in this specification or to any novel one, or any novel combination, of the steps of the method herein disclosed.

The invention claimed is:

1. A self-sealing, non-latex balloon having a body and a stem comprising, in combination:

a first balloon sheet having an interior surface and a periphery;

a second balloon sheet bonded to the periphery of the interior surface of the first balloon sheet so as to define the body and the stem;

a self sealing valve comprising first and second flexible plastic strips bonded to each other to define an elongate passageway, said valve having a first floating portion within the body and a second portion which is bonded within the stem and defines an inlet; and an LED or a sound source mounted in the balloon, between the first and second balloon sheets;

wherein the LED or sound source is part of an electronic unit mounted inside the balloon in or adjacent the stem of the balloon, said unit also including a battery power source for the LED or sound source and a displaceable actuator to connect the LED or sound source to the power source, and wherein said unit is secured to the valve by an attachment cover which is bonded to at least one of the strips of the valve, and is itself bonded within the stem of the balloon.

2. A balloon according to claim 1 wherein the first and second flexible plastic strips of the valve and the attachment cover are configured to have winged portions which are aligned and bonded to each other.

3. A balloon according to claim 2 wherein the first and second balloon sheets are configured with enlargements adjacent the stem of the balloon to accommodate said winged portions of the valve and the attachment cover.

4. A balloon according to claim 1 wherein the displaceable actuator comprises a removable tab initially located between said LED or sound source and its power source, removal of which serves to illuminate the LED or energize the sound source by connection to its power source.

5. A balloon according to claim 4 wherein the first balloon sheet is provided with an aperture in the stem permitting access to the valve inlet and the second balloon sheet is provided with an aperture for projection therethrough of a portion of the removable tab.

6. A balloon according to claim 4 wherein the removable tab is configured to have an outer end region of enlarged width and a second region of enlarged width at a spacing from the enlarged outer end region.

7. A balloon according to claim 1 wherein the displaceable actuator comprises a switch initially located between said LED or sound source and its power source, displacement of which serves to illuminate the LED or energize the sound source by connection to its power source.

8. A method of production of a self-sealing, non-latex balloon having a body and a stem defined by a first balloon sheet bonded to a periphery of a second balloon sheet, said method comprising the steps of:

forming a self sealing valve by bonding first and second flexible plastic strips to each other to define an elongate passageway having an inlet and outlet;

providing an electronic unit comprising an LED or sound source, a battery power source for the LED or sound source and a displaceable actuator to connect the LED or sound source to the power source;

positioning the electronic unit to overlie the second flexible plastic strip with the displaceable actuator extending towards the inlet of the valve;

placing an attachment cover to overlie the electronic unit and bonding the attachment cover to the second flexible plastic strip so as to secure the unit thereto;

positioning the bonded valve and electronic unit between in register first and second balloon sheets in the vicinity of the stem so that the electronic unit is located just beyond the stem between body portions of the balloon sheets and the displaceable actuator extends into the stem; and bonding the first and second balloon sheets together and to said valve and said attachment cover so that the valve has a first floating portion within the body of the balloon and a second portion bonded to the balloon stem.

* * * * *